US006522060B2

(12) United States Patent
Kim

(10) Patent No.: US 6,522,060 B2
(45) Date of Patent: Feb. 18, 2003

(54) DEFLECTION YOKE FOR BRAUN TUBE

(75) Inventor: Gyoo Hwan Kim, Gumi (KR)

(73) Assignee: LG Electronics Inc., Seoul (KR)

( * ) Notice: Subject to any disclaimer, the term of this patent is extended or adjusted under 35 U.S.C. 154(b) by 245 days.

(21) Appl. No.: 09/730,730

(22) Filed: Dec. 7, 2000

(65) Prior Publication Data

US 2001/0040426 A1 Nov. 15, 2001

(30) Foreign Application Priority Data

Dec. 10, 1999 (KR) ..... 99-56659
Dec. 10, 1999 (KR) ..... 99-56661

(51) Int. Cl.[7] ..... H01J 29/70
(52) U.S. Cl. ..... 313/440; 335/210; 335/213
(58) Field of Search ..... 313/440; 335/210–213

(56) References Cited

U.S. PATENT DOCUMENTS 5,121,028 A * 6/1992 Milili ..... 313/440
6,069,546 A * 5/2000 Azzi et al. ..... 313/440

* cited by examiner

*Primary Examiner*—Robert H. Kim
*Assistant Examiner*—Elizabeth Gemmell
(74) *Attorney, Agent, or Firm*—Fleshner & Kim, LLP

(57) ABSTRACT

A deflection yoke for Braun tube includes an opening flange coil, a main deflection portion coil extended with a predetermined length from the both end portions of the opening flange coil backwardly; a first neck flange coil connected to the extended end portion of the main deflection portion coil; and a second neck flange coil formed at the front side of the first neck flange coil, wherein, assuming that the height of the first neck flange coil is 'h', the length of the second neck flange coil is 'I' and their ratio (I/h) is 'A', 'A' is greater than 0.5 and smaller than 2.0, and assuming that the length of the main deflection portion coil is 'L', the length of the second neck flange coil is 'I' and their ratio (I/L) is 'B', 'B' is greater than 0.04 and smaller than 0.24. Since the ratio of the length of the second neck flange coil to the length of the main deflection portion coil of the horizontal deflection coil and the height of the first neck flange coil is set in a predetermined range, the optimum neck shadow space can be obtained and the deflection sensitivity can be improved. In addition, the productivity of Braun tube and the adjusting work for ITC can be enhanced.

2 Claims, 7 Drawing Sheets

DEFLECTION YOKE FOR BRAUN TUBE

BACKGROUND OF THE INVENTION

1. Field of the Invention

The present invention relates to a deflection yoke for Braun tube, and more particularly, to a deflection yoke for Braun tube having a pair of horizontal deflection coil and a vertical deflection coil formed in a half-muscle type in which the height of a first neck flange coil of the horizontal deflection coil and the length of a main deflection part coil are in a predetermined ratio for the length of a second neck flange coil, to thereby optimize a neck shadow and improve a deflection sensitivity and a screen adjustment characteristic (Integrated Tube Component).

2. Description of the Background Art

FIG. 1 is a schematic sectional view showing internal structure of a general Braun tube in accordance with a conventional art.

As shown in the drawing, a general Braun tube includes an electron gun 4 for discharging three electron beams 7, a screen 1 on which the electron beams 7 hit to produce an image, a shadow mask 2 for discriminating the three electron beams 7, a deflection yoke 3 for deflecting the electron beams onto a predetermined fluorescent face of the screen 1.

Reference numeral 5 denotes a panel, 6*a* denotes a screen unit of a funnel, and 6*b* denotes a neck part of the funnel.

Thusly constructed Braun tube performs a function to receive an electric signal for a picture from an external source and change it to a light signal so as to be displayed as a picture having functions of a position and a content (color) on the fluorescent face of the screen.

Accordingly, the content signal having information on the color of the picture displayed on the screen is applied to the electron gun 4, and a color combination of a red (R) electron beam, a green (G) electron beam and a blue (B) electron beam is appropriately made to display a desired color on the screen.

The content signal of the picture is applied to the deflection yoke 3, so that the position point of the screen which the R, G and B electron beams radiated from the electron gun 4 reach is adjusted to display a desired picture.

FIG. 2 shows a detailed view of the deflection yoke. As shown in the drawing, the deflection yoke 3 includes a horizontal deflection coil 31 for horizontally deflecting the electron beam radiated from the electron gun 4 installed in Braun tube, a vertical deflection coil 33 for vertically deflecting the electron beam the electron beam, a conical ferrite core 34 for reducing the loss of a magnetic force generated from the horizontal deflection coil 31 and the verticaldeflectioncoil33,toheightenmagnetizationefficiency, and a holder 32 for fixing the horizontal and vertical deflection coils 31 and 33 and the ferrite core 34 at a determined position and for insulating the horizontal deflection coil 31 and the vertical deflection coil 33.

After the thusly constructed deflection yoke 3 is mounted at the neck part, when current is applied to the horizontal deflection coil and the vertical deflection coil, a desired picture is displayed on the screen.

The operation of the general deflection yoke 3 constructed as described above will now be explained.

Generally, current having a frequency of 15.75 KHz or more flows to the horizontal deflection coil 31 of the deflection yoke, to generate a magnetic field. By using the magnetic field, the electron beams inside Braun tube are deflected in the horizontal direction.

Likewise, current which usually has a frequency of 50 Hz flows to the vertical deflection coil 33, to generate a magnetic field. By using the magnetic field, the electron beams are deflected in a vertical direction.

Recently, a self-convergence type deflection yoke has been developed in which, by virtue of a nonuniform magnetic field according to the horizontal deflection coil 31 and the vertical deflection coil 33, the three electron beams can make a convergence on the screen even without any supplementary circuit or any supplementary unit.

That is, the winding distributions of the horizontal deflection coil 31 and of the vertical deflection coil 33 are adjusted to generate a barrel type magnetic field or a pin-cushion type magnetic field by regions (i.e., an opening part (a screen flange unit), a middle part or a neck part, etc). Thus, the three electron beams have different deflection forces each other, so that the electron beams can be converged into the same point in different distances from the starting positions of the electron beams to the screen 1, the reaching position.

In the case that current flows to the horizontal and vertical deflection coils 31 and 33 to generate a magnetic field, since it is difficult to deflect the electron beams onto the entire surface of the screen only with the magnetic field according to the horizontal and vertical deflection coils 31 and 33, the ferrite core 34 of high permeability is used to minimize the loss on the return path of the magnetic field, thereby heightening the efficiency of the magnetic field and thus increasing the magnetic force.

Also, in order to heighten the deflection sensitivity, generally, the deflection coil is moved toward the electron gun. In this case, however, a problem arises that the neck shadow (a region formed in order for the deflected electron beam to hit the funnel portion to thereby prevent the electron beam from reaching the screen) is shortened.

Reversely, in case that the deflection coil is moved toward the screen to obtain a sufficient space for the neck shadow, since the deflection sensitivity representing a capability in deflecting the entire screen is deteriorated due to a constant amount of current applied from an external source. Thus, in this case, more current needs to flow thereto.

Accordingly, the deflection sensitivity and the neck shadow are hardly compatible. In an effort to solve the problem, there has been proposed a coil winding type of a half muscle type coil, that is, a medium type between the flange type coil and the muscle type coil.

FIGS. 3A and 3B are perspective view showing a flange type coil and a muscle type coil in accordance with the conventional art.

As shown in FIG. 3A, in case of the flange type coil, once the length and a position are determined in a simulation, a complementing coverage to complement it during designing is very limited.

For example, a method for complementing the deflection sensitivity during designing exists merely to make an electrically connected state. Actually, in order to complement the deflection sensitivity, the flanges 31*a* and 31*b*, portions where a magnetic field for making deflection is not almost generated, and especially, the flange 31*a* of the opening, are to be minimized and the position of a main deflection portion coil 31*d*, that is, the portion which generates a main deflection magnetic field is to be complemented.

However, in this case, since the form of a frame mechanically configuring the flange type coil should be changed, it is very difficult to complement it during designing.

Meanwhile, in case of the muscle type coil, as shown in FIG. 3B, unlike the flange type coil, it doesn't have a flange at the neck portion, so that the position of a window can be adjusted to control the sensitivity to a level and adjust the neck shadow. However, it is disadvantageous in that the overall length of the deflection yoke coil is changed due to the basic form size and position, limiting its designing operation for an optimum setting.

FIG. 4 is a perspective view of a general half-muscle type deflection coil in accordance with the conventional art, FIGS. 5A though 5C are respectively a front view, a side view and a plan view of the general half-muscle type deflection coil in accordance with the conventional art, and FIG. 6 is a view showing a pattern of a misconvergence of a screen according to a deflection coil in accordance with the conventional art.

As shown in the drawings, the half-muscle type horizontal deflection coil 31 or the half-muscle type vertical deflection coil 33 have a form that can suitably optimize the deflection sensitivity and the neck shadow. The half-muscle type coil includes an opening flange coil 31*a*, a first neck flange coil 31*b* having a flange, a second neck flange coil 31*c* formed in a horizontal direction, and a main deflection portion coil 31*d* connecting the opening flange coil 31*a* and the first neck flange coil 31*b*.

In this respect, when the pair of horizontal and vertical deflection coils 31 and 33 fabricated as described above are combined to face each other and current is applied thereto to proceed a screen adjustment of Braun tube, the following problems arise.

That is, generally, Braun tube and the deflection yoke has an error in its fabrication, and due to various factors such as allowances of elements themselves in initial fabrication to be used for Braun tube and assembly allowances between the elements, there occurs asymmetry between an 'R' beam and a 'B' beam, as shown in FIG. 6. Thus, in order to solve the asymmetry, a magnetic material is typically attached to the neck portion of the deflection yoke.

However, as for the half-muscle type horizontal deflection coil 31, in order to obtain the length of the neck shadow, in case that the length 'I' of the second neck flange coil is extended to the screen, the height (vertical width) 'h' of the first neck flange coil is lowered down, causing a problem that the leakage magnetic field due to the first neck flange coil of the deflection yoke is reduced.

Accordingly, as the leakage magnetic field is reduced, even when a bar-type magnetic material is attached as in the conventional art, the asymmetry between the 'R' beam and the 'B' beam generated on the screen is hardly controlled.

SUMMARY OF THE INVENTION

Therefore, an object of the present invention is to provide a deflection yoke for Braun tube suitable to have a good adjustment when the deflection yoke and Braun tube are in an ITC (Integrated Tube Components) procedure, improve a deflection sensitivity and optimize the characteristics of a neck shadow.

To achieve these and other advantages and in accordance with the purpose of the present invention, as embodied and broadly described herein, there is provided a deflection yoke for Braun tube having a horizontal deflection coil including: an opening flange coil; a main deflection portion coil extended with a predetermined length from the both end portions of the opening flange coil backwardly; a first neck flange coil connected to the extended end portions of the main deflection portion coil; and a second neck flange coil formed at the front side of the first neck flange coil, wherein, assuming that the height of the first neck flange coil is 'h', the length of the second neck flange coil is 'I' and their ratio (I/h) is 'A', 'A' is greater than 0.5 and smaller than 2.0.

To achieve the above objects, there is also provided a deflection yoke for Braun tube having a horizontal deflection coil including: an opening flange coil; a main deflection portion coil extended with a predetermined length from the both end portions of the opening flange coil backwardly; a first neck flange coil connected to the extended end portions of the main deflection portion coil; and a second neck flange coil formed at the front side of the first neck flange coil, wherein, assuming that the length of the main deflection portion coil is 'L', the length of the second neck flange coil is 'I' and their ratio (I/L) is 'B', 'B' is greater than 0.04 and smaller than 0.24.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

A first embodiment of the present invention will now be described.

According to a first embodiment, in determining the winding configuration ratio between the first neck flange coil and the second neck flange coil of the half-muscle type horizontal deflection coil to be inserted to a deflection yoke, the height 'h' of the first neck flange coil and the length 'I' of the second neck flange coil are adjusted in a predetermined winding configuration ratio so as to be fabricated in an optimum winding configuration ratio.

Figure 1:
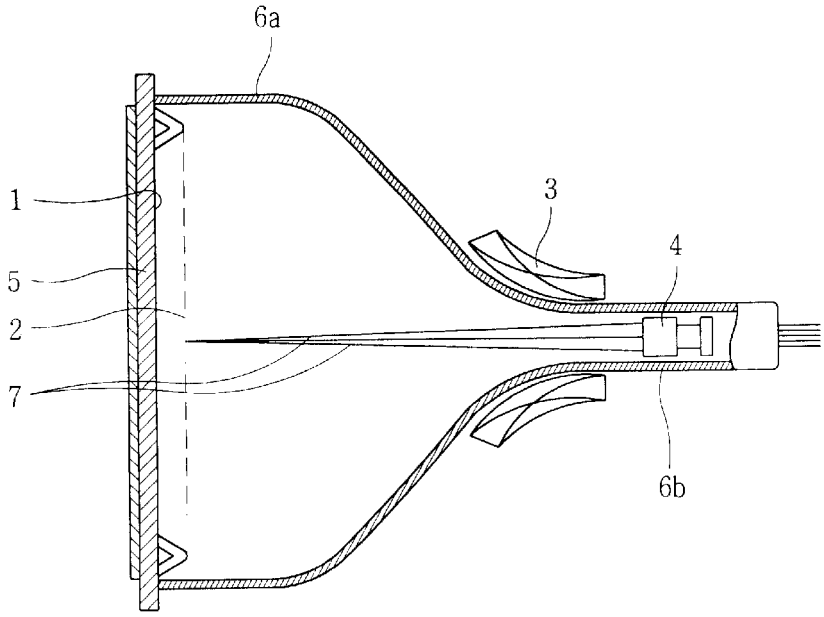
FIG. 1 CONVENTIONAL ART
FIG. 1 is a schematic view showing internal structure of a general Braun tube in accordance with a conventional art.
Figure 2:
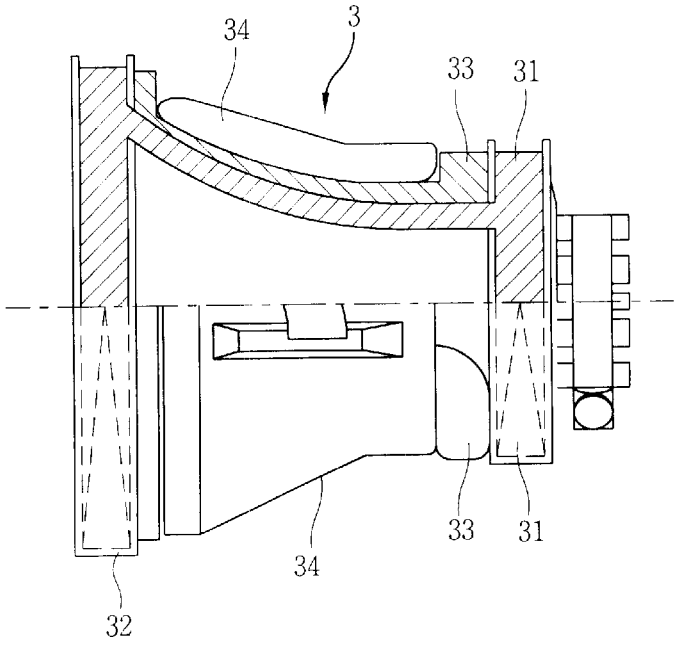
FIG. 2 CONVENTIONAL ART
FIG. 2 is a schematic view of a general deflection yoke in accordance with the conventional art.
Figure 3A:
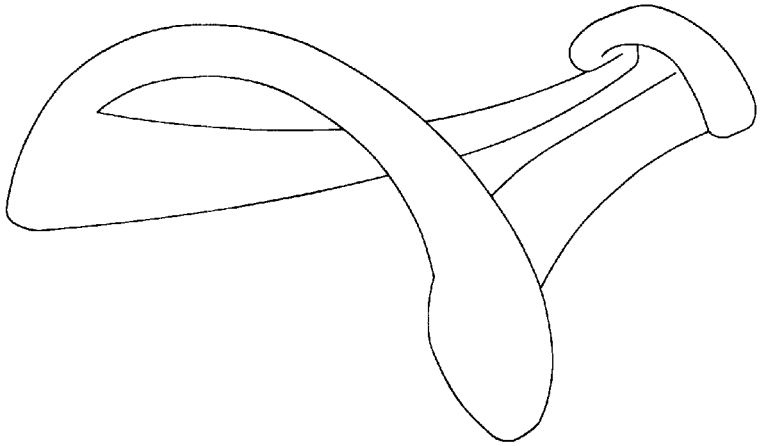
FIG. 3A CONVENTIONAL ART
FIGS. 3A and 3B are perspective view of a flange type coil and a muscle type coil in accordance with the conventional art.
Figure 3B:
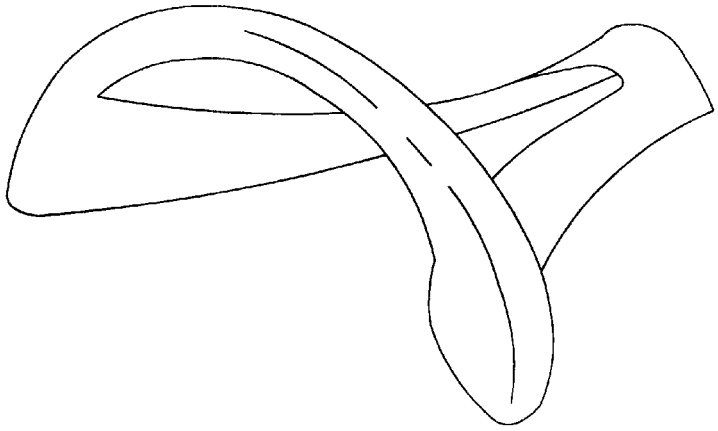
FIG. 3B CONVENTIONAL ART
Figure 4:
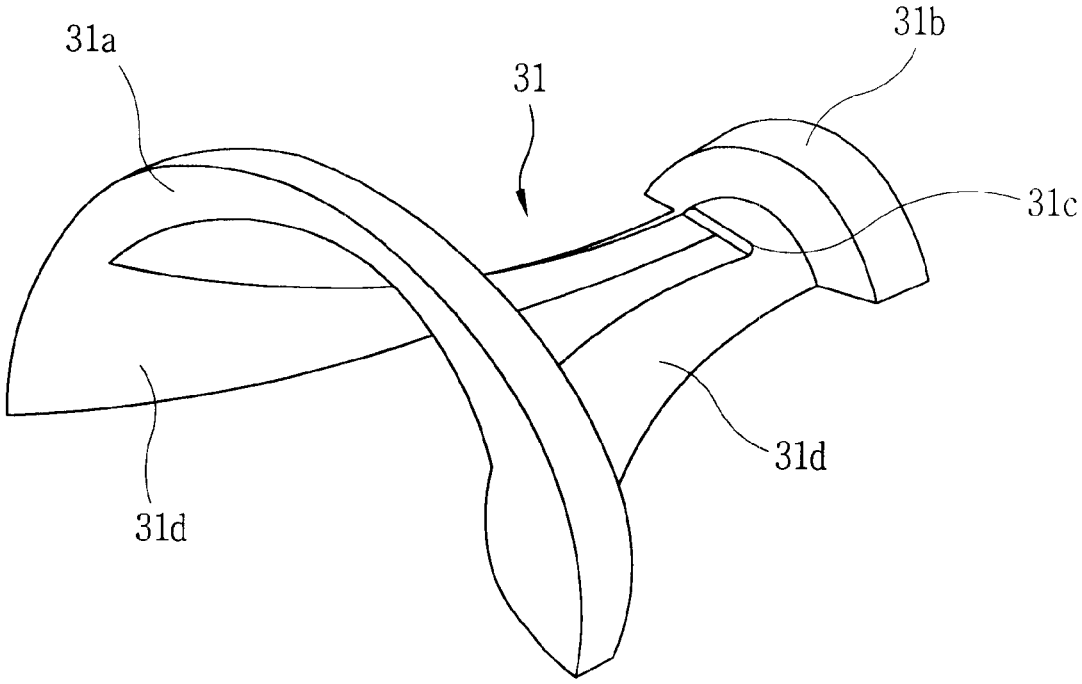
FIG. 4 CONVENTIONAL ART
FIG. 4 is a perspective view of a general half-muscle type deflection coil in accordance with the conventional art.
Figure 5A:
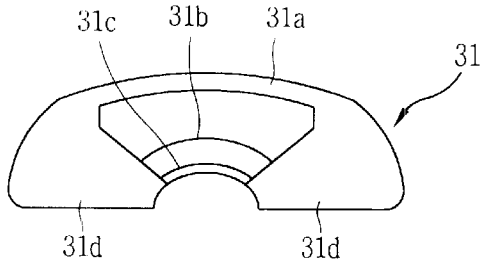
FIG. 5A CONVENTIONAL ART
FIGS. 5A though 5C are respectively a front view, a side view and a plan view of the general half-muscle type deflection coil in accordance with the conventional art.
Figure 5B:
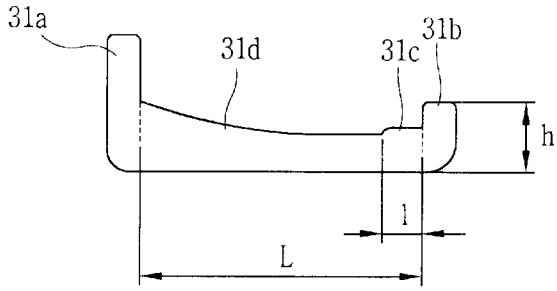
FIG. 5B CONVENTIONAL ART
Figure 5C:
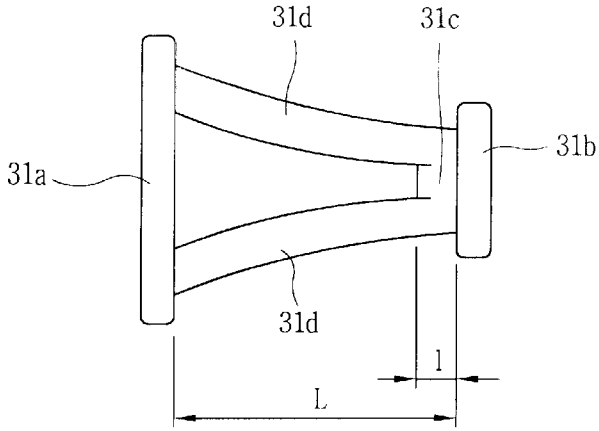
FIG. 5C CONVENTIONAL ART
Figure 6:
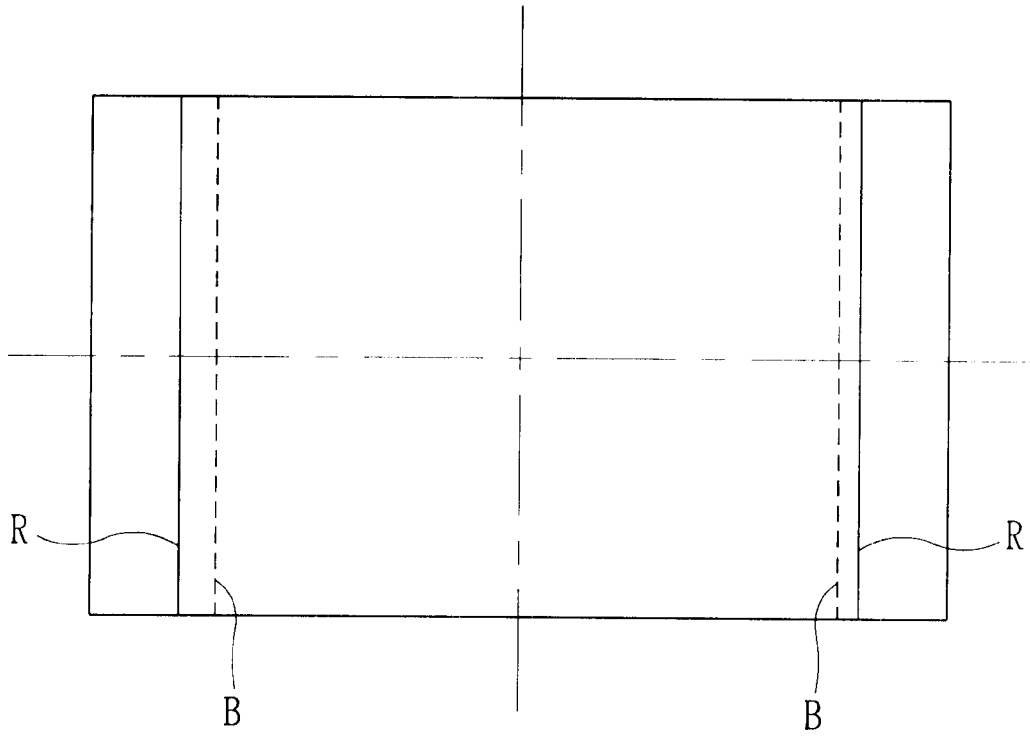
FIG. 6 CONVENTIONAL ART
FIG. 6 is a view showing a pattern of a misconvergence of a screen according to a deflection coil in accordance with the conventional art.
Figure 7A:
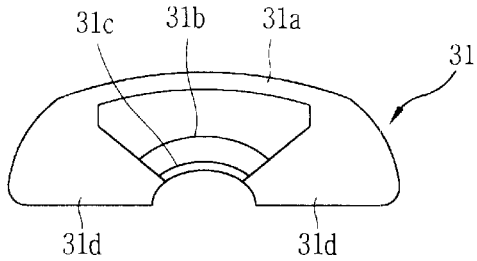
FIGS. 7A though 7C are respectively a front view, a side view and a plan view of a half-muscle type deflection coil in accordance with the present invention.
Figure 8:
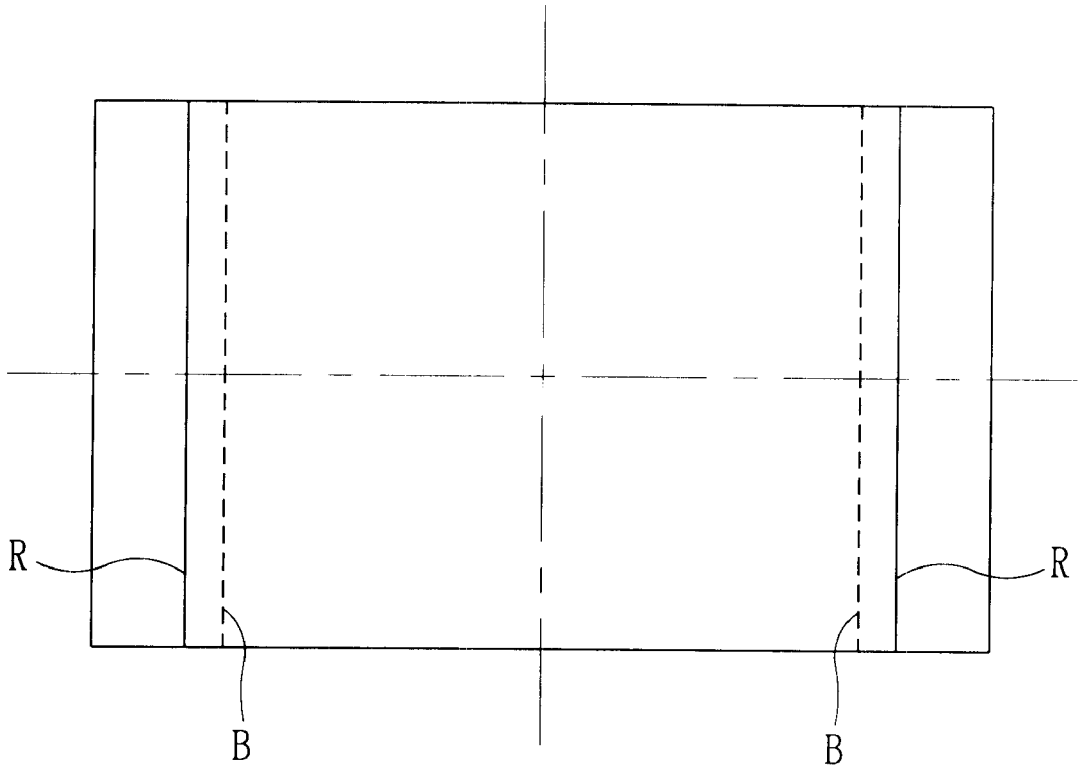
FIG. 8 shows a pattern according to a deflection coil adopted to the deflection yoke in accordance with the present invention.

FIGS. 7A though 7C are respectively a front view, a side view and a plan view of the half-muscle type deflection coil in accordance with the present invention, and FIG. 8 shows a pattern according to a deflection coil adopted to the deflection yoke in accordance with the present invention.

Figure 7B:
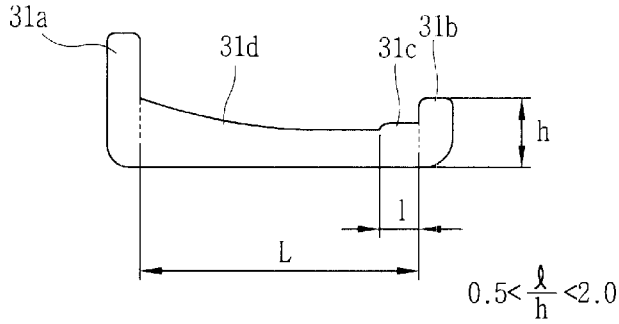
Figure 7C:
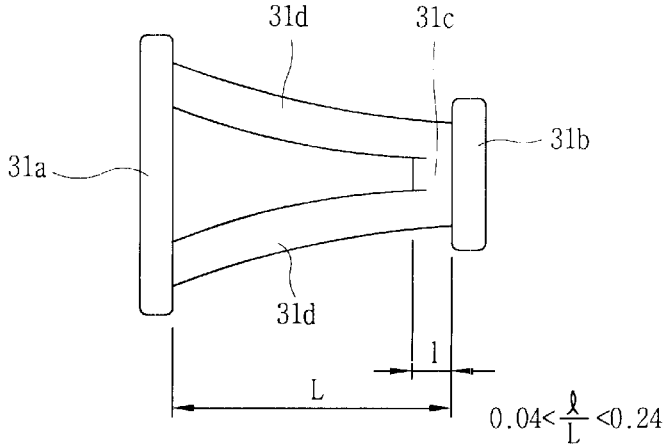

With reference to FIGS. 7A through 7C, on the assumption that the region set for compensation, that is, the ratio between the height of the first neck flange coil 31*b* and the second neck flange coil 31*c* of the horizontal deflection coil 31, is set by A=I/h as described above, if 'A' is set smaller than 0.5, in case that the first neck flange coil 31*b* is set high, since the second neck flange coil 31*c* is shortened, the deflection sensitivity compensation capability is reduced.

Meanwhile, if A is set greater than 2.0, since the second neck flange coil 31*c* is lengthened, the deflection sensitivity can be made desirable, but since the first neck flange coil 31*b* becomes low, the rate of an inductance component created by the first neck flange coil 31*b* is accordingly low. Thus, since the leakage magnetic field becomes weak, it is not possible to correct the APH asymmetry (a phenomenon that the R/B beam at the point of 3 o'clock and 9 o'clock does not agree each other on the screen) with the attachment of the bar-type magnetic material.

Therefore, in case where the half-muscle type horizontal deflection coil is wound, assuming that the ratio between the height of the first neck flange coil 31*b* and the length of the second neck flange coil 31*c* is A=I/h, the optimum winding configuration ratio between the height of the first neck flange coil and the length of the second neck flange coil would be 0.5<A<2.0.

In determining a winding configuration ratio between the first neck flange coil and the second neck flange coil, the area of each coil is computed and a predetermined winding configuration ratio is obtained according to a quantitative value.

In detail, the quantity of the coil to be wound on the second neck flange coil 31*c* is proportionate to the area formed by a section thereof.

For example, in case that the length is set 22 mm and height is set 1.5 mm for a coil amount of the second neck flange coil 31*c*, its area would be 33 $mm^2$, while, in case that the length is set 6 mm and the height is set 10 mm for a coil amount of the first neck flange coil 31*b*, its area would be 60 $mm^2$.

In this respect, the ratio between the two portions may be set by A=33/60=0.55, and in this case, a deflection sensitivity is maintained at 15 mHA2 level and the APH asymmetry can be corrected at the level of 0.4 mm by using the conventional bar-type magnetic material.

In the above description of the first embodiment, in forming the first neck flange coil and the second neck flange coil in a predetermined winding configuration ratio, the height of the first neck flange and the length of the second neck flange or their area ratio are adjusted. However, in order to adjust the leakage or the deflection sensitivity to an appropriate level, the configuration of the first neck flange coil and the second neck flange coil may be changed or its winding method may be changed.

A second embodiment of the present invention will now be described with reference to FIGS. 7A through 7C.

According to a second embodiment, in determining the winding configuration ratio between the main deflection portion coil the second neck flange coil of the half-muscle type horizontal deflection coil to be inserted to a deflection yoke, the length of the main deflection portion coil and the length of the second neck flange coil are adjusted in a predetermined winding configuration ratio so as to be fabricated in an optimum winding configuration ratio.

As described above, in the case where the deflection coil for fabricating the half-muscle type horizontal deflection coil 31 and the vertical deflection coil 33 is wound, when the ratio 'B' (I/L) between the length of the main deflection portion coil and the length of the second neck flange coil is in the range of 0.04<B<0.24, notably, the optimum designing value for the deflection sensitivity and the neck shadow phenomenon was obtained.

The predetermined range is a value determined in consideration of a range that can be changed according to a set size of a neck flange of the half-muscle type coil.

In designing the deflection yoke, misconvergence, distortion, deflection sensitivity and neck shadow should be considered. In this respect, there is a direction adopted in designing as follows.

First, in case that a magnetic field central value is positioned at the side of the neck than the central value of a vertical deflection magnetic field, a favorable misconvergence characteristic is obtained.

Meanwhile, in case that a vertical deflection magnetic field is positioned at the side of the neck rather than the central value of a horizontal deflection magnetic field, it is helpful to make a distortion in a barrel type at the upper and lower sides of the screen. In this respect, however, it is noted that as the vertical deflection magnetic field is formed near the neck, the characteristic of the neck shadow characteristic is degraded.

And, as the horizontal deflection coil is lengthened, the overall misconvergence is improved. Meanwhile, in case that the deflection central point is moved toward the screen while lengthening the horizontal deflection coil, a deflection sensitivity is weakened.

When designing or simulation is performed with such a basic designing concept as described above, in case that the value of the ratio B(I/L) of the horizontal deflection coil is set more than 0.24, since the length 'I' of the second flange coil, that is, a sub-deflection portion coil, is lengthened compared to the length 'L' of the main deflection portion coil, its neck shadow characteristic is degraded.

Meanwhile, in case that the value of the ratio B(I/L) is set below 0.04, since the length 'I' of the second flange coil, that is, the sub-deflection portion coil, is shortened compared to the length 'L' of the main deflection portion coil, a desired deflection sensitivity is hardly obtained.

This will now be explained on the basis of an actually designed length. On the assumption that the length of the horizontal deflection coil is 99 mm and the length of the main deflection portion coil is 87 mm, in case that the second flange coil is formed 15 mm, B=0.172.

At this time, in case that the length of the vertical deflection coil is set 75 mm, the length of the main deflection portion coil is set 3 mm and the length of the second flange coil is set 12 mm to thereby obtain B=0.19, its horizontal deflection sensitivity is obtained by the level of 15 $mHA^2$ with reference to 19'Braun tube, so that its neck shadow value can be obtained by the level of about 5 mm.

As occasion demands, the height of the neck portion flange coil may be varied, according to which the ratio 'B' can be changed in a predetermined range. The change in the height of the neck portion flange coil would lead to a variation of the deflection sensitivity. Thus, in order to complement it, the second flange coil may be set greater or smaller, to reflect the change of the deflection sensitivity.

As so far described, according to the deflection yoke for Braun tube of the present invention, since the ratio of the length of the second neck flange coil to the is length of the main deflection portion coil of the horizontal deflection coil and the height of the first neck flange coil is set in a predetermined range, the optimum neck shadow space can be obtained and the deflection sensitivity can be improved. In addition, as shown in FIG. 8, the APH symmetry can be accomplished, and the productivity of Braun tube and the adjusting work for ITC can be enhanced.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the meets and bounds of the claims, or equivalence of such meets and bounds are therefore intended to be embraced by the appended claims.

What is claimed is:

1. A deflection yoke for Braun tube having a horizontal deflection coil comprising:

an opening flange coil;

a main deflection portion coil extended with a predetermined length from the both end portions of the opening flange coil backwardly;

a first neck flange coil connected to the extended end portions of the main deflection portion coil; and a second neck flange coil formed at the front side of the first neck flange coil, wherein, assuming that the height of the first neck flange coil is 'h', the length of the second neck flange coil is 'I' and their ratio (I/h) is 'A', 'A' is greater than 0.5 and smaller than 2.0.

2. A deflection yoke for Braun tube having a horizontal deflection coil comprising:

an opening flange coil;

a main deflection portion coil extended with a predetermined length from the both end portions of the opening flange coil backwardly;

a first neck flange coil connected to the extended end portions of the main deflection portion coil; and a second neck flange coil formed at the front side of the first neck flange coil, wherein, assuming that the length of the main deflection portion coil is 'L', the length of the second neck flange coil is 'I' and their ratio (I/L) is 'B', 'B' is greater than 0.04 and smaller than 0.24.

* * * * *